US006065713A

United States Patent [19]

Perenon

[11] Patent Number: 6,065,713

[45] Date of Patent: May 23, 2000

[54] TWO-CHUCK COILER FOR THE WINDING OF A BAND-TYPE PRODUCT

[75] Inventor: Rémi Perenon, Villars, France

[73] Assignee: Kvaerner Metals Clecim, Paris, France

[21] Appl. No.: 09/066,982

[22] Filed: Apr. 27, 1998

[30] Foreign Application Priority Data

Apr. 30, 1997 [FR] France ..... 97 05409

[51] Int. Cl.[7] ..... B65H 19/22; B65H 19/30

[52] U.S. Cl. ..... 242/533.4; 242/559.2

[58] Field of Search ..... 242/533.4, 559.2, 242/555.5

[56] References Cited

U.S. PATENT DOCUMENTS 2,769,600 11/1956 Kwitek et al. .
3,985,313 10/1976 Klein et al. ..... 242/533.5
4,266,735 5/1981 Leanna et al. .

FOREIGN PATENT DOCUMENTS 0 407 070 1/1991 European Pat. Off. .
2 727 952 6/1996 France .

*Primary Examiner*—John Q. Nguyen
*Attorney, Agent, or Firm*—Arent Fox Kintner Plotkin & Kahn, PLLC

[57] ABSTRACT

A revolver-type coiler comprising at least two rotary chucks (21, 22) carried by a revolving mounting (1) enabling to place each chuck (21), successively into a first position (A) for starting the winding operation, then into a second position (B) for completion of the winding and unloading of the coil (3). The coiler comprises a continuous supporting device (4, 41, 5) for the end (24) of each chuck (21) opposite to the mounting (1) from the first starting position (A) to the complete winding position (B), comprising at least one rotary removable resting member (4) resting on the fixed frame (12) and installed to rotate, with the revolving mounting (1) in order to support the end (24) of the chuck (21) from the first starting position (A) to the second complete winding position (B).

8 Claims, 7 Drawing Sheets

TWO-CHUCK COILER FOR THE WINDING OF A BAND-TYPE PRODUCT

FIELD OF THE INVENTION

This invention relates to a revolver coiler for winding a band-type product on one of at least two winding chucks.

BACKGROUND OF THE INVENTION

The metal band production units generally comprise several sections with different functions, such as hot rolling, etching, cold rolling and finishing.

Even if, in some cases, some sections can be gathered, it is generally necessary to wind the band into a coil, at the outlet of a section, in order to convey it to the following section.

To this end, a coiler is used, comprising a chuck constituted of a shaft brought into rotation around its axis and on which can be fixed, in a removable way, the end of the band. By rotation of the chuck around its axis, the band is wound around the chuck, into superimposed spires, until completion of a coil.

Most often, the chuck extends cantilever from a frame carrying the rotation driving means of the chuck and is provided with a system enabling to pull it backwards to allow retraction of the coil.

Generally, the band is maintained under traction in order to tighten the spires. When the coil reaches the requested diameter, corresponding to a certain band length, it is withdrawn from the chuck.

After withdrawal of the coil, the leading edge of the following band is caused to reach the chuck and the operation can resume.

Retraction of the fully wound coil and the beginning of the winding operation of the following coil causes a down-time whose duration should be kept to a minimum. Indeed, it is preferable not to interrupt the passage of the band in the treatment unit upstream of the coiler and we are therefore led to connect the said treatment unit to a buffer system whose capacity depends on the down-time necessary to changing the coil.

To reduce this down-time, it has been suggested to use a so-called <<revolver-type coiler>> unit, comprising a revolving mounting, able to rotate around a central axis on a fixed frame and on which are fixed at least two chucks extending cantilever on a same side of the mounting from an embedded end. Each chuck can be brought into rotation around its axis which is parallel to the central axis.

By orienting the revolving mounting, each chuck can be placed in at least two successive positions. In a first winding starting position, the leading edge of the band is attached onto the chuck and the rotation of the latter is controlled in order to wind the band over a certain number of spires. Then, by rotation of the revolving mounting, the first chuck, while winding, is brought into a second position enabling to complete the winding of the band. At the same time, by rotating the revolving mounting, the second chuck is placed into the first starting position, thus waiting for the subsequent operation.

Thus, when the requested length of the band has been wound around the first chuck, it is cut off along a shearing line perpendicular to the passage direction and the ends of the band located upstream of this shearing line which constitutes the leading edge of the following band, can be attached immediately onto the second chuck in a waiting position in order to start the winding of the following band during the time necessary to unloading the coil which has been completely wound.

The first chuck is then released and may come back, by rotation of the mounting, into the first starting position. At the same time, the second chuck, on which the first spires have been wound, is placed into the 'completed winding' position.

Such a <<revolver-type coiler>> thus enables to reduce the downtimes considerably.

Obviously, other arrangements are possible and, for instance, the coiler could comprise three chucks brought successively, by rotation of the mounting, into a first starting position, a second complete winding position and a third unloading position.

As stated, each chuck extends, normally, cantilever, from the revolving mounting in order to enable the retraction of the coil after winding, by sliding axially towards the side opposite to the mounting. However, since the coil is very heavy, it is preferable during the winding operation, that the end of the chuck opposite to the mounting rests on a removable counterbearing.

In the single-chuck coilers, the counterbearing is simply placed on a retractable bracket forming a chair resting on the ground or on a section of the fixed frame.

Upon completion of the winding operation, the supporting chair is taken away from the chuck to enable the retraction of the coil.

In revolver-type coilers, it is also possible to use a removable counterbearing mounted in a supporting chair which is arranged in the complete winding position, in order to support the chuck up to the completion of the winding operation, i.e. when the coil is the heaviest. Conversely, the chuck in the starting position is generally left idle and its end which is embedded in the revolving mounting, is subjected to important loads caused by the weight of the coil which increases gradually and, besides, to the traction load which must be modulated according to the diameter and which is particularly high at the beginning of the winding operation.

Obviously, it would be possible to connect a second supporting chair to the chuck in starting position, but such a device would be rather cumbersome and, anyway, would provide a rest for the chuck only for winding the first spires, since the chuck remains cantilever during its rotation, from the starting position to the complete winding position.

The purpose of the invention is to overcome these shortcomings thanks to a new arrangement enabling to support the chuck in all the positions and, even during the rotation of the revolving mounting.

SUMMARY OF THE INVENTION

The invention therefore applies generally to a revolver-type coiler comprising a revolving mounting, able to rotate around a central axis on a fixed frame, at least two chucks installed to rotate on the revolving mounting, each around an axis, out of centre and parallel to the central axis, extending cantilever on a same side of the revolving mounting from an embedded end on the mounting up to an opposite end, means for selective control of the rotation of one of both chucks around its axis, and means to control the rotation of the revolving mounting around its central axis, for selective positioning of a first winding chuck into a first winding starting position, then the switching of the said winding chuck from the first position to at least one second position for complete winding and unloading of the coil, with simultaneous return of the second unloaded chuck, from the said second position to the first position.

According to the invention, the coiler comprises a continuous supporting device of the end opposite to the revolving mounting of the shaft of each winding chuck, from the first starting position to the complete winding position, whereas the said supporting member comprises at least one rotary removable resting member for the said end opposite to the winding chuck, resting on the fixed frame via supporting means, installed to rotate together with the revolving mounting around the central axis of the said revolving mounting, and means to control, respectively, the engagement of the resting member onto the end of the chuck in the first starting position and up to the second complete winding position, and the disengagement of the resting member whereas the supporting means move away into a third position, sufficiently far from the chuck to enable unloading of the wound coil.

Particularly advantageously, the supporting means of the removable resting member comprise at least one supporting arm resting, at a distance greater than the width of a coil, on one end of at least one resting stem fixed at its other end, in the revolving mounting and extending along a direction parallel to the central axis, whereas the supporting arm is articulated on the said resting stem around an axis, in order to pivot between the engagement position of the resting member on the end of the chuck and the retracted position enabling to unload the wound coil.

The articulation axis of the supporting arm can be perpendicular to the central axis, whereby the supporting arm moves to a plane substantially parallel to that axis, in the unloading position.

But the articulation axis can also be parallel to the central axis, whereas the supporting arm is then offset at an angle with respect to the chucks so that the resting member is moved away from the said chucks sufficiently not to disturb the unloading of a completely wound coil.

According to a first embodiment, the supporting arm is articulated on a single stem forming a resting shaft centred on the central axis of rotation of the revolving mounting. In such a case, the central resting shaft can advantageously be arranged to rotate around the axis on the said revolving mounting with the possibility to slide at an angle, whereas the coiler comprises means to apply onto the resting shaft, a rotational torque around the central axis, adjusted in order to compensate for the weight of the coil during winding and the torque resulting from the traction exerted on the band, so that the resultant of the various loads applied onto the supporting arm by the chuck during winding is exerted along a direction going through substantially the central axis of the revolving mounting.

According to another embodiment, the supporting arm of the resting member comprises two branches articulated respectively on two resting stems offset symmetrically on both sides of the plane passing through the axes of the chucks, at a distance sufficient from the said plane to enable winding of a coil on each chuck up to a maximum radius corresponding to the distance between the central axis and the axis of the chuck.

In such a case, each resting stem forms a beam extending cantilever from the revolving mounting and having a straight section, of sufficient inertia, to withstand the loads applied onto the chuck by the band under traction.

Preferably, the removable resting member comprises a counterbearing, liable to engage, by relative axial displacement, onto a journal arranged at the end of the chuck opposite to the revolving mounting.

Generally, each chuck is of the type comprising segments radially moveable under the action of a control stem, sliding axially through a bore provided in the shaft of the chuck.

In such a case, the supporting journal of the chuck is advantageously provided at the end of the control stem and can engage in a removable way, by axial displacement of the said stem, into a recess corresponding to the supporting arm after positioning of the latter in the axis of the chuck.

According to another advantageous embodiment, the removable resting member is made of at least two jaws each located at the end of an arm mounted to pivot on a resting stem around an axis parallel to the central axis, between an open position for which both jaws are moved away from the chuck at sufficient distance to allow removal of the coil, and a closed position on which the jaws are tightened onto the end of the chuck, thus forming a clamp.

Preferably, in the case of a two-chuck coiler, the said coiler is provided with two resting members each comprising a pair of jaws and installed on two pivoting arms, each carrying two jaws belonging respectively to each of both resting members so that one of both chucks is supported alternately by pivoting both arms into one direction or the other, whereas both jaws of a pair are in closed position on one of the chucks when both jaws of the other pair are spread away from one another, in open position, on both sides of the other chuck, in order to allow unloading of the wound coil.

The invention also covers various advantageous arrangements, subject matter of the sub-claims and will be understood better using the following description of certain embodiments given for exemplification purposes and represented on the appended drawings.

DETAILED DESCRIPTION OF THE PREFERRED EMBODIMENT

Figure 2:
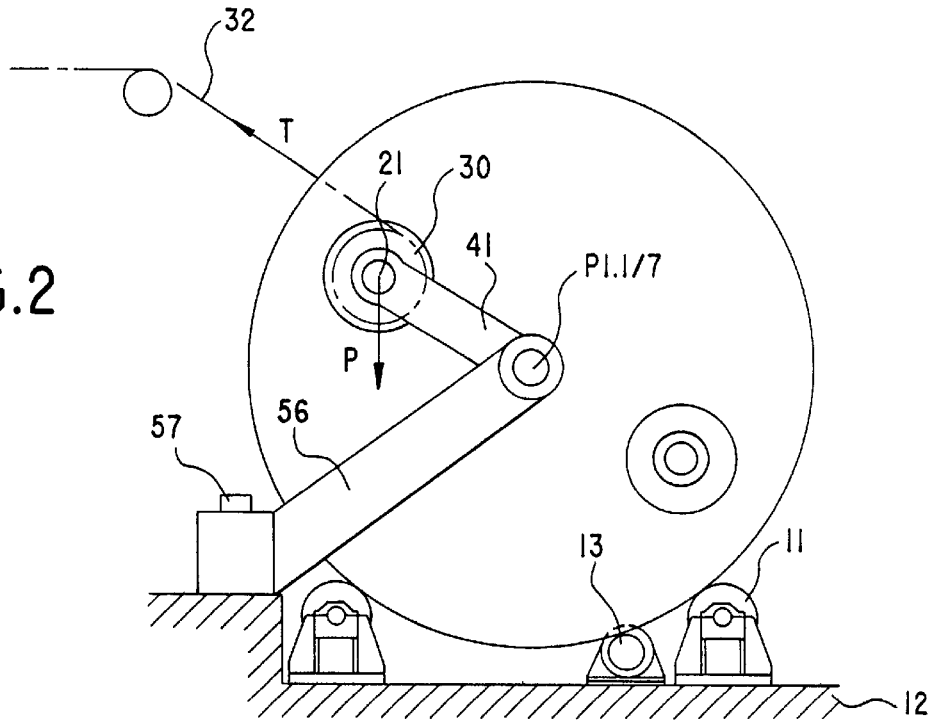
FIG. 2 if a diagrammatic front view of the coiler of FIG. 1.

Like reference numbers refer to like parts throughout the several embodiments shown in the drawings.

Figure 1:
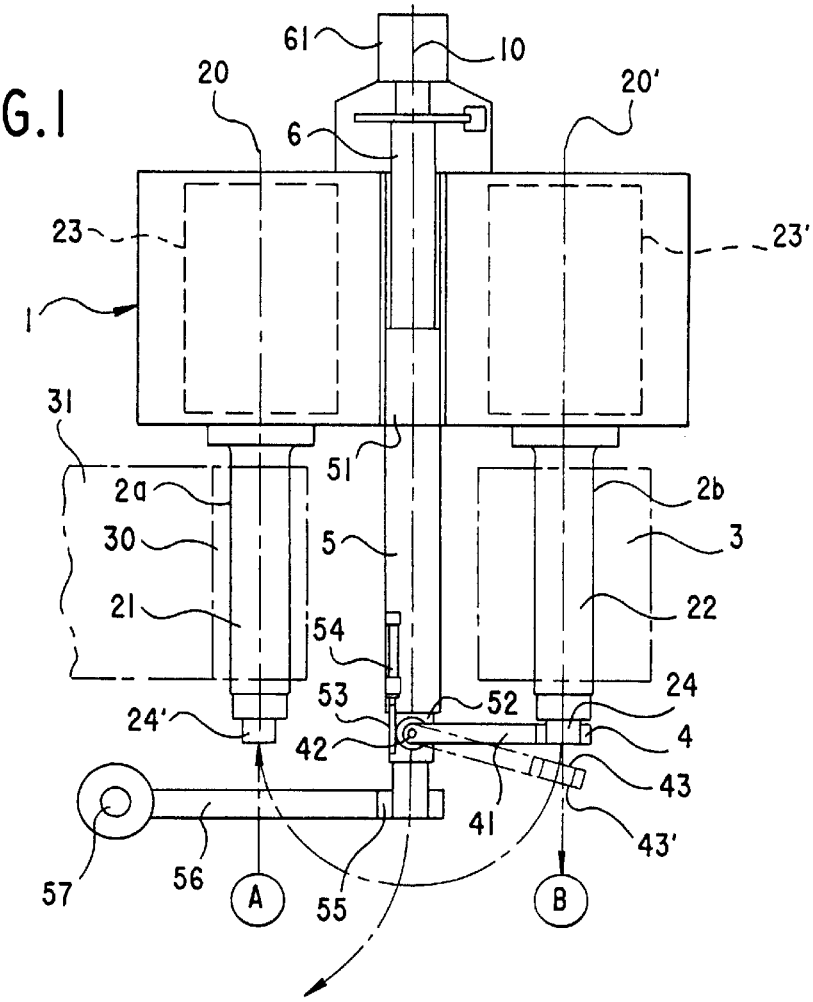
FIG. 1 is a diagrammatic top view of a revolver-type coiler provided with a device according to the invention.

FIGS. 1 and 2 are diagrammatic views, a top and a front ones, of a revolver-type coiler comprising, conventionally a revolving mounting 1 installed to rotate around a central axis 10, whereby the mounting is constituted, for instance, of a cylindrical drum circulating on spaced rollers 11 mounted to rotate on a foundation block 12 or a fixed frame, each around an axis parallel to the central axis. A rotation control means such as a pinion 13 brought into rotation and engaging into a toothed crown not represented, provided on the circumference of the drum 1 enables to causes the latter to rotate around its axis 10.

The mounting 1 comprises two winding chucks 21, 22 extending cantilever from the mounting 1 and on a same side of the latter. Each chuck 21, 22 is installed on a shaft 2, and can be brought into rotation around an axis 20, 20' parallel to the axis 10 of the revolving mounting 1 via, for example, a stand alone motor 23, 23' installed in the mounting 1. The rotation motor 23 can be hydraulic or electric, but other known rotation control means can be used, for instance, a mechanism arranged inside the mounting 1 and driven by at least one motor in order to control selectively the rotation of one of both chucks.

Figure 9:
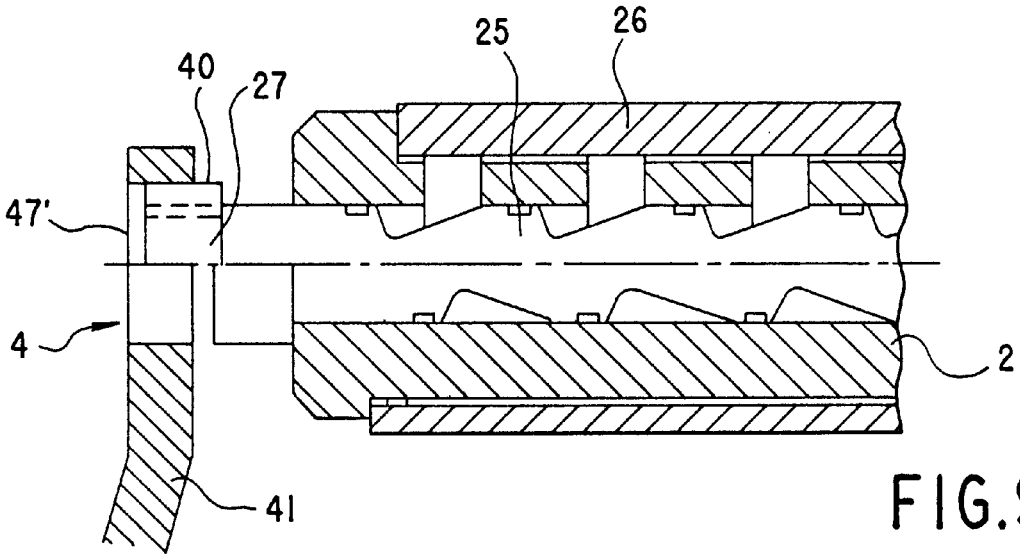
FIG. 9 is a detailed view, as an axial section, of an engagement system of the removable resting member at the end of the chuck.

Each chuck is constituted, conventionally, of a shaft 2 associated, as indicated on FIG. 9, with a set of adjacent segments 26 mounted to slide radially on the shaft 2 and actuated by a stem 25 passing through an axial bore of the shaft 2 and carrying a rack which controls the expansion of the chuck by spreading apart the segments for hooking and winding the band, then bringing the segments together to enable retraction of the coil, upon completion of the winding operation.

All these arrangements are well-known and do not call for any detailed explanation.

Generally, the revolving mounting enables to place each of both chucks successively into a first position A for starting the winding operation, then into a second position B when winding is completed and the coil can be extracted. Normally, both positions A and B are diametrically opposite one another, so that one of the chucks 21 is in the starting position A when the other chuck 22 is in the coil extraction position B.

As specified above, once a coil 3 has been wound around the chuck 22 after shearing of the band, it is possible, in position A, to attach onto the chuck 21 the end 31 of the band situated upstream of the shearing line and constituting the leading edge of the following band and to control the rotation of the chuck 21 using the corresponding motor 23 to initiate the winding operation of the following coil 30 during the time necessary to the extraction of the coil 3 wound around the chuck 22 in position B.

When starting the winding operation, a winder E of well-known type is used, represented diagrammatically on FIG. 12 and which is placed, after the beginning of the winding operation, into an away position without disturbing the rotation of the revolving mounting.

To enable extraction of the coil, the shaft 2 of each chuck is embedded in the mounting 1 at its end turned towards the latter and thus extends cantilever while supporting the weight of the coil 3.

However, during the winding operation, the end 24 of the shaft 2 of the chuck opposite to the mounting 1 can, according to the invention, rest in a removable way on the foundation block 12 or on a fixed frame, via a rotary resting member 4.

In a first embodiment of the invention, represented on FIG. 1, the resting member 4 comprises a counterbearing arranged at the end of a supporting arm 41 which, at its other end, is installed at the end of a central shaft 5 centred on the central axis 10 and whose opposite end 51 is embedded in the revolving mounting 1.

Moreover, the supporting arm 41 is articulated on the free end 52 of the central shaft 5 around an axis 42 perpendicular to the central axis 10 in order to enable a 180° rotation of the supporting arm 41 with the counterbearing. The latter is, on the other hand, arranged so that both is lateral faces 43, 43' can engage in a removable way onto a journal provided at the end 24 of the shaft of the chuck 2.

Thus, at the end of the winding operation of the coil 3 and after shearing of the band, it is possible to control immediately a 180° rotation of the supporting arm 41 around its axis 42 in order to release the counterbearing from the chuck 22 carrying the wound coil 3 and to engage the coil, by its opposite face 43', onto the journal 24 located at the end of the chuck 21 thus lying in the waiting position A.

The rotation of the arm 41 can be controlled by any means, easy to be designed and carried by the central shaft 5, for instance, a rack 53 actuated by a jack 54 and engaging onto a pinion centred on the axis 42 and interlocked with the arm 41 to rotate together with the latter.

Moreover, the counterbearing can be provided, on both its lateral faces 43, 43', with two joint bearings engaging, into one direction or the other, onto one of the journals 24, 24', with a clearance enabling the arm 41 to rotate.

This operation can be performed during the time necessary to engaging the leading edge 31 of the new coil onto the chuck 21. Thus, as from the beginning of the winding operation, the chuck 21 is supported, at its end 24, by the resting member 4.

The traction load applied to the band to enable the band to be wound does not cause, therefore, any deflection of the chuck 21 which is maintained at both its ends respectively by the revolving mounting 1 and by the resting member 4 and the corresponding reaction is transmitted to the foundation block by the arm 41, the central shaft 5 and the mounting 1.

The central shaft 5 which is embedded, by its end 51, on the mounting 1 may exhibit the stiffness necessary to withstand this reaction. However, it is preferable that the opposite end 52 of the central shaft 5 rests directly on the foundation block, for instance using a counterbearing 55 which can engage in a removable way on the end 52 of the shaft 5, whereas the counterbearing 55 is carried, to this end, by a supporting arm 56, for example as represented on FIG. 2.

In order not to disturb the rotation of the supporting arm 41, the arm 56 carrying the counterbearing 55 and resting on the foundation block 12, is mounted to rotate around an axis 57 placed away from the central axis 10 and from the axis 20 of the chuck 21.

Thus, upon completion of the winding of the coil 3 around the chuck 22, it is thus possible to move away the arm 56 and the counterbearing 55 by rotation around the axis 57, then to control the rotation of the supporting arm 41 so that the resting member 4 may engage onto the end 24 of the chuck 21 in waiting position A. The counterbearing 55 can then be brought onto the end 52 of the central shaft 5 by rotation of the arm 56.

As specified above, the supporting arm 41 is installed to pivot around the axis 42, at the end 52 of the central shaft 5 and the latter can be interlocked to rotate with the revolving mounting 1 when the shaft 21 is brought from the starting position A to the complete winding position B.

It can be seen that, throughout this rotation, the resting member 4 remains engaged onto the journal 24 of the chuck 21 and thus enables the latter to sustain the traction load applied by the band without any risk of deflection of the chuck 21, whereby the reaction is relayed by the central shaft 5.

However, according to a more sophisticated arrangement represented diagrammatically on FIGS. 1 and 2, the central shaft 5 is installed to rotate around the axis 10 on the revolving mounting 1, in order to enable an angular sliding motion and is associated with a torque motor 61, provided on an extension 6 of the shaft 5 and enabling to apply on the latter a rotational torque.

As indicated diagrammatically on FIG. 2, to ensure correct winding of the band 32 on the chuck 21, while forming a coil 30, the band 32 is subject to a traction load T whose distance to the rotational axis 20 increases gradually, as well as the weight P of the coil 30 which is added to the solo weight of the arm 41.

The resultant of the loads thus applied to the end of the arm 41 exerts, therefore, on the latter a variable rotational torque.

According to the invention, the torque motor 61 exerts on the central shaft 5, a compensation torque of reverse direction, which is adjusted permanently in relation to the length of the wound band and to the orientation of the stretched edge 32 so that the reaction applied onto the supporting arm 41, which is the resultant from the traction load T applied onto the band and from the weight of the coil 30, substantially passes through the central axis 10.

FIG. 5 represents, for informative purposes, three operating steps.

Figure 5A:
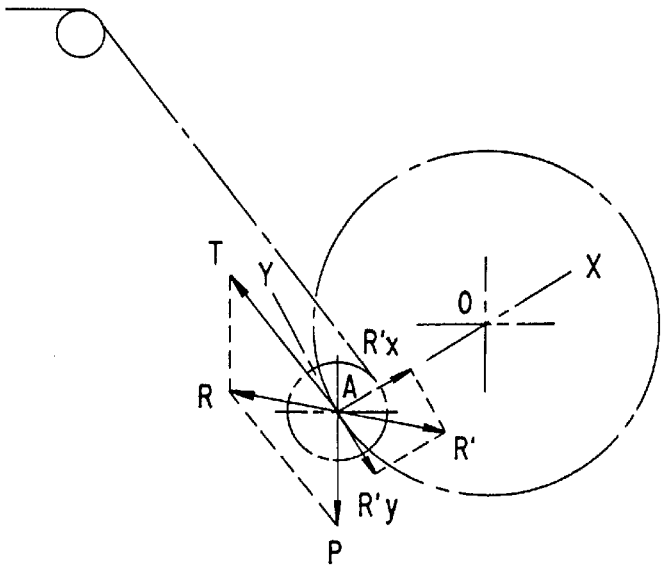
FIGS. 5*a*, 5*b*, and 5*c* show gdiagrammatically the loads applied onto the chucks, in three successive positions of the revolving mounting.
Figure 5B:
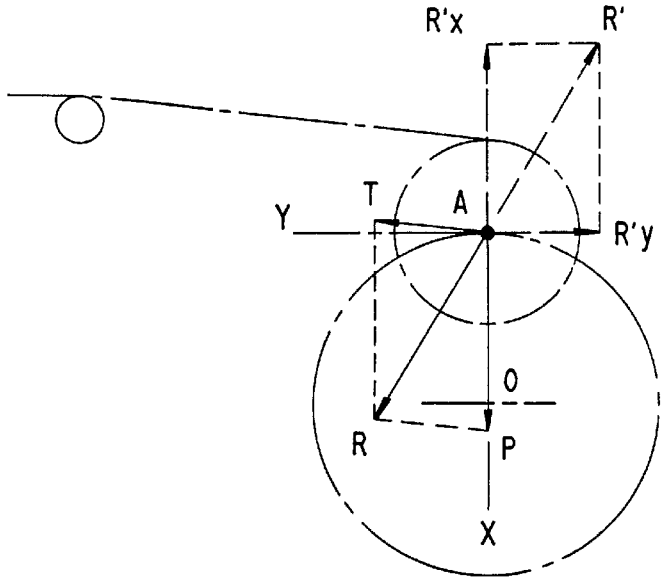

FIG. 5*a* shows the starting position for which the load P applied on to the axis of the chuck is relatively low, for example one ton. The traction applied can be in the order of 2.5 T. The resultant R, directed upwards, is compensated for by an opposed load R' with a component R'x relayed by the supporting arm and a component R'y relayed by the application of the torque. It can be seen that, in that position, the supporting arm OA is subject to a traction and the torque is applied in the trigonometric direction.

After the winding operation has started, the rotation of the revolving mounting is controlled. In the intermediate position represented on FIG. 5*b*, the load applied P can be in the order of 20 T and the traction T about 7 T, whereas the representation scale of the loads is modified.

The resultant R is directed downwards and the load P is relayed essentially by the supporting arm OA which is compressed. The torque is then directed negatively, opposite to the traction load.

Figure 5C:
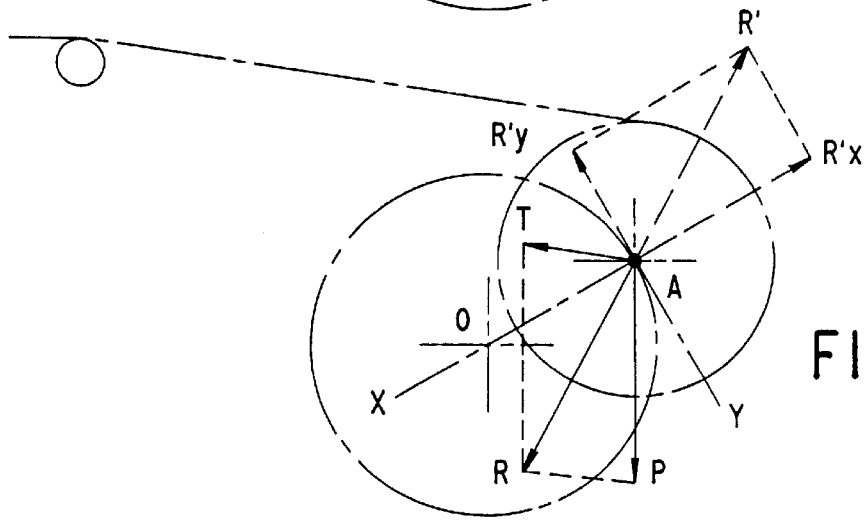

FIG. 5*c* corresponds to the unloading position, upon completion of the winding. The load P can be 30 T, whereas the traction is equal to 15 T. The torque is again applied positively and compensates essentially for the load P.

Thanks to the application of a variable torque onto the supporting arm 41, the deflection torque applied by the band is reduced to a minimum, whereby the supporting arm is, practically, only subject to traction or compression loads.

It may prove necessary, however, to interlock the rotation of the central shaft 5 with the revolving mounting 1. Such is the case for instance when the traction between the last roll stand and the coiler is not applied or can be disturbed, particularly after cutting the end of a coil and when tackling the leading edge of the following one.

It is therefore advantageous to install on the mounting 1 a brake liable to block the rotation of the shaft 5. Thus, the coiler can operate, either with the application of a modulated compensation torque or with the interlocking of the central shaft.

Figure 4:
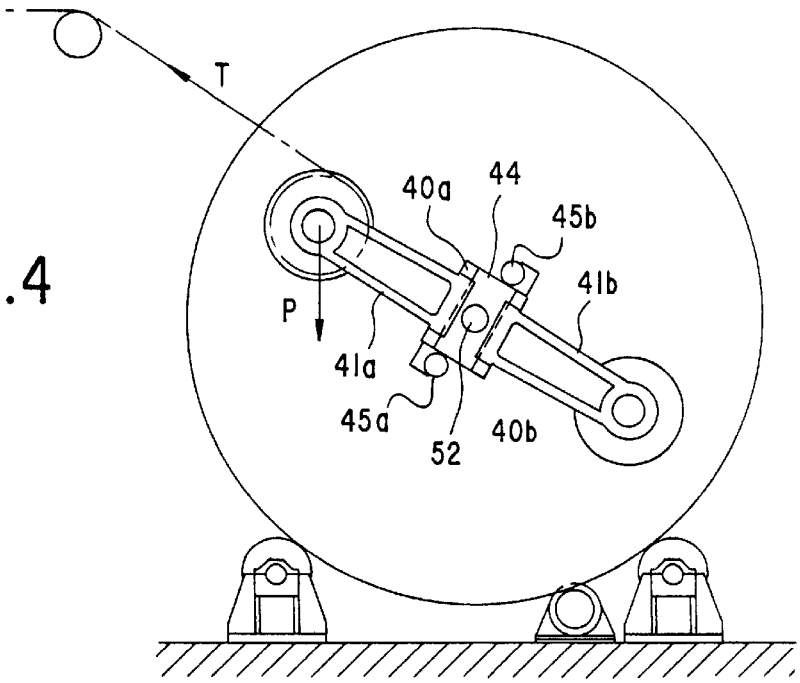
FIG. 4 is a front view of an assembly mode of the supporting arms.
Figure 3:
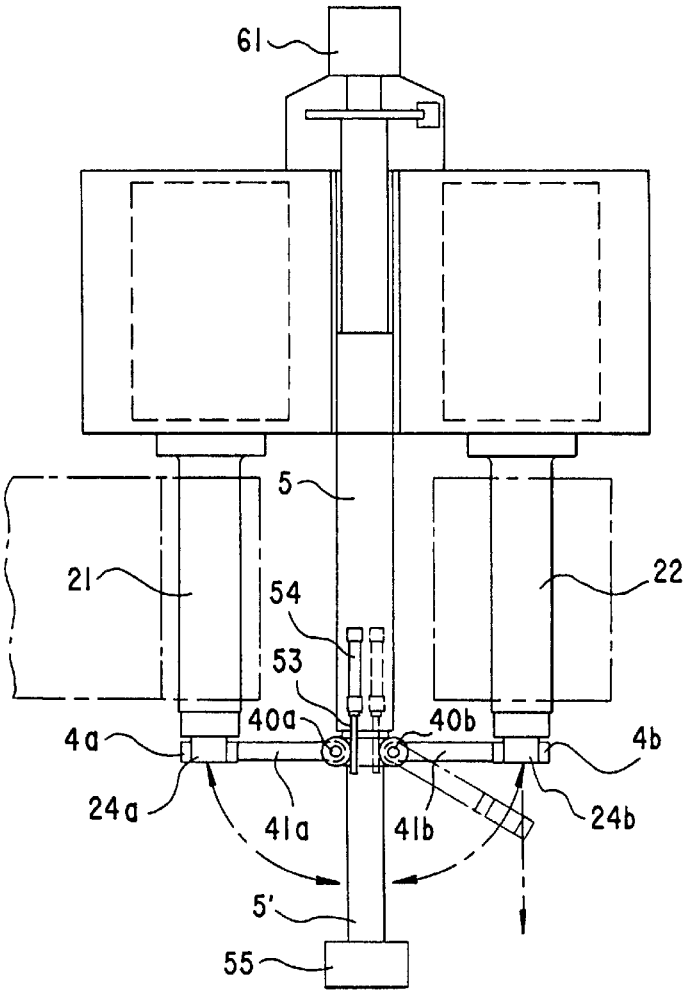
FIG. 3 is a top view of another arrangement of the supporting arms.

In the embodiment shown on FIGS. 3 and 4, both chucks 21, 22 are associated respectively with two resting members 4*a*, 4*b*, each installed at the end of a supporting arm 41*a*, 41*b* articulated at the end of the central shaft 5 around an axis perpendicular to the central shaft 10. For instance, as shown on FIGS. 4 and 5, both supporting arms 41*a*, 41*b* can be articulated on a part 44 forming a core which is keyed at the end 52 of the central shaft 5 in order to rotate with the latter. Each arm 41*a*, 41*b* can be associated with a rotary hydraulic jack 45*a*, 45*b* which controls the rotation of the arm around its axis.

In such a case, the counterbearing located at the end of the arm 41*a*, 41*b* is arranged in order to engage into a single direction at the end 24 of the chuck, by rotation around its axis.

Preferably, as shown on FIG. 3, the counterbearing 55 Supporting the central shaft 5 is installed at the end of a stem 5' placed in the extension of the shaft 5 in order to enable the rotation of one of both arms 41*a*, 41*b* for releasing the corresponding resting member 4*a*, 4*b*. In such a case, the counterbearing 55 does not disturb the unloading motion of the coil and can be installed in a fixed bracket resting on the foundation block 12.

The central shaft 5 must exhibit a minimum section ensuring sufficient stiffness to sustain the reaction of the chucks. Consequently, the maximum diameter of the coil that can be wound around each chuck is limited to the distance between the axis 20 of the chuck and the circumference of the shaft 5.

Figure 6:
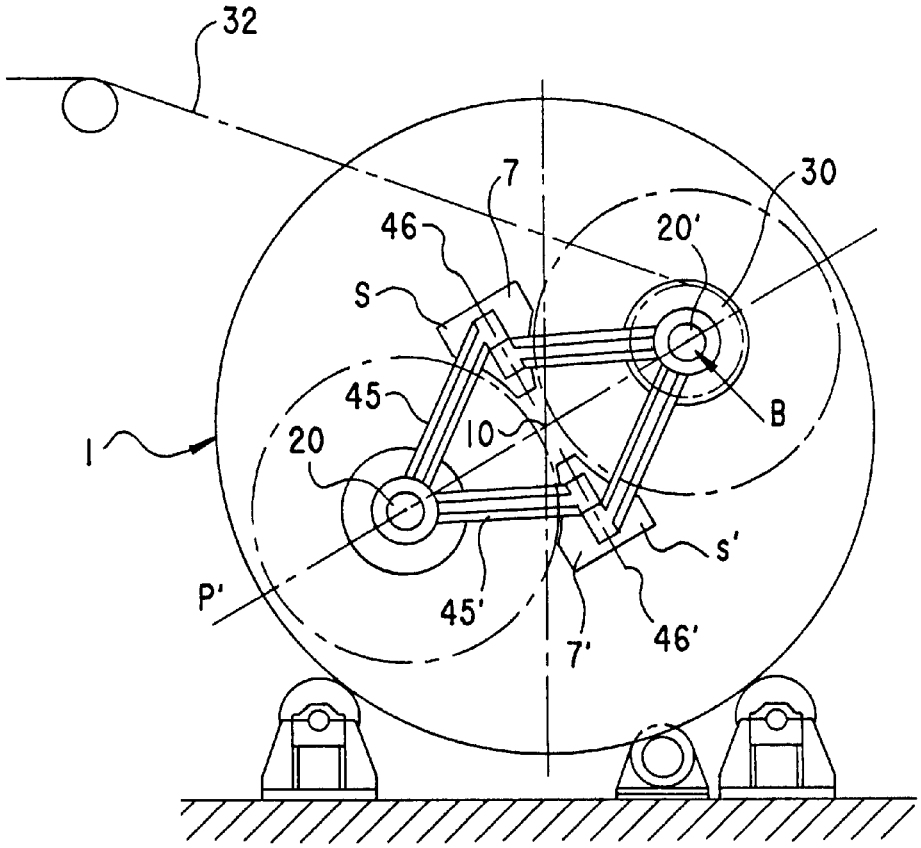
FIG. 6 is a diagrammatic front view of another embodiment of the invention.

To increase this maximum diameter, the arrangement represented diagrammatically on FIG. 6 can be used and in which the reaction is sustained by two stems 7, 7' extending cantilever from the revolving mounting 1 and are spread apart symmetrically on both sides of the plane P' going through the axes of both chucks.

In such a case, each supporting arm carrying a resting member 4 is constituted of two branches 45, 45' articulated respectively on both resting stems 7, 7' around axes 46, 46' which are aligned and perpendicular to the plane P' going through the axes of both chucks.

Both stems 7, 7' form each a beam embedded in the mounting 1 and extending cantilever. They must therefore exhibit, in their straight section, sufficient inertia to sustain the loads applied to the chuck by the band 32 under traction.

To enable winding each coil up to a maximum diameter, each stem 7, 7' must be circumscribed within the space limited by both circles centred on the axes 20, 20' of the chucks and having a radius equal to the distance between the axis 20 of the chuck and the central axis 10. Preferably, each stem 7, 7' has substantially a triangular a section and is limited by curved faces forming circular sectors centred on the axes 20 and 20'.

Besides, in the embodiments described up to now, each supporting arm is articulated around an axis perpendicular to the central axis 10 and takes on a position parallel to that axis to enable unloading of the wound coil.

However, the resting member 4 can also be released by pivoting around an axis parallel to the central axis 10, whereby the resting member 4 remains thus in a plane perpendicular to that axis.

Figure 7:
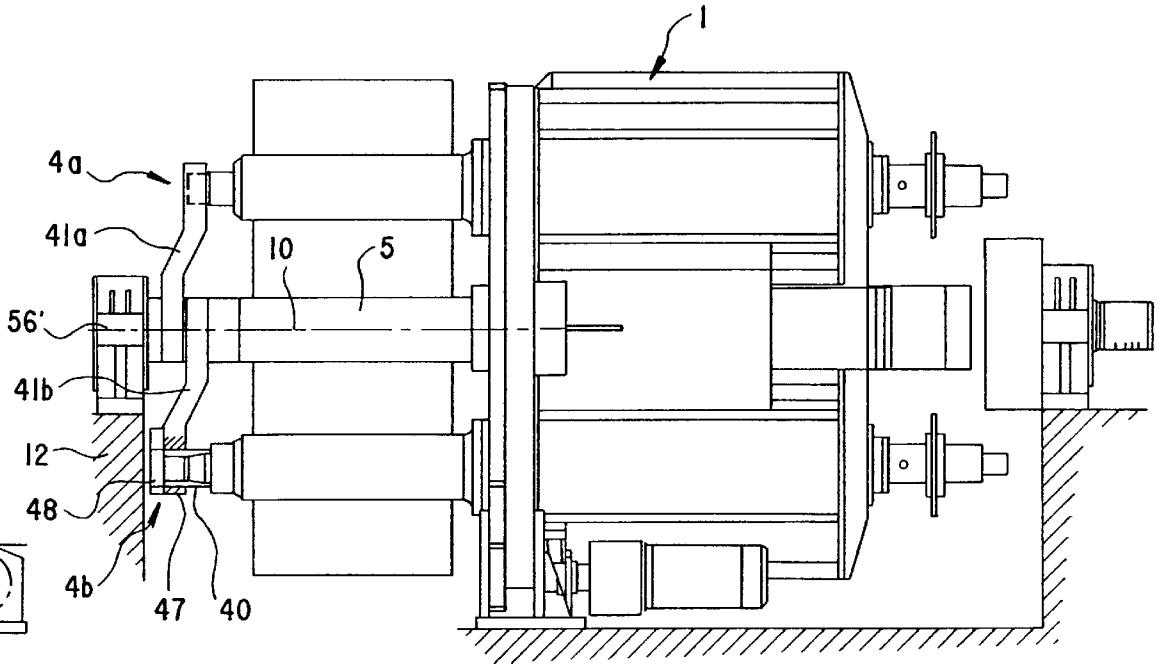
FIG. 7 is an elevation view of another embodiment.

For instance, in the arrangement represented on FIG. 7, the coiler is provided with two resting members 4*a*, 4*b* carried respectively by the ends of both arms 41*a*, 41*b* which are installed to pivot at the end of a central shaft 5, around the axis 10 of the latter.

Figure 8:
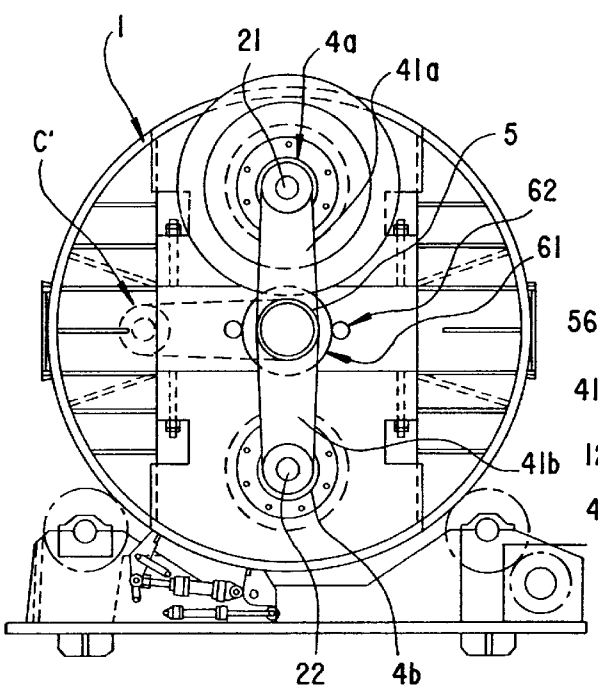
FIG. 8 is a front view of the embodiment of FIG. 7.

As shown diagrammatically on FIG. 8, which is a front view of the coiler, each arm 41*a*, 41*b* can be associated with a toothed sector 61 on which engages a fixed pinion 62 driven into rotation by a mechanism not represented which can advantageously be mounted in a fixed supporting member 56' carrying a bearing used for centring the end of the shaft 5 opposite the revolving mounting 1, whereas the fixed supporting member 56' can be simply fixed to the frame or the foundation block 12.

Thus, as shown on FIG. 8, each resting member 4*a*, 4*b* may be placed, by simple rotation of the supporting arm around the axis 10, either in the alignment of the axis of a chuck or into an away position C' for which the supporting arm 41*a*, 41*b* is, for instance, perpendicular to the plane going through the axes of the chucks 21, 22.

To enable engaging and disengaging of the resting member 4*a*, 4*b* the latter comprises advantageously a counterbearing 40 carried by a part 47 mounted to slide axially at the end of the supporting arm 41*a*, 41*b* carrying a member 48 to control the sliding motion, for instance a jack or a screw/nut system.

However, as indicated previously, a winding chuck is generally constituted of a set of segments mounted to slide radially on a rotation shaft and whose expansion or retraction can be actuated via a control stem, sliding axially.

Therefore, in another advantageous embodiment represented in FIG. 9, the resting member 4*a*, 4*b* comprises a counterbearing 40 which can be mounted at the end 27 of the expansion stem 25 and engages into a corresponding recess provided at the end of the supporting arm 41*a*, 41*b* when the control stem 25 is caused to slide axially to determine the expansion of the chuck. Conversely, once a coil has been wound completely, the control stem is brought back to determine the retraction of the chuck and, at the same time, the counterbearing 40 is released from the recess, which enables pivoting the arm 41*a*, 41*b* to the away position C'.

Obviously, the invention does not limit itself to the details of the embodiments which have just been described, other arrangements and equivalent means can be employed, without departing from the scope defined by the claims, to provide, according to the invention, permanent support of the chucks.

Especially, the counterbearing which constitutes the removable resting member, can be formed by two semi-bushes provided on two mobile jaws liable to be tightened, like a clamp at the end 24 of the shaft of the chuck and to move away from the latter to enable unloading of the wound coil.

To this end, both jaws of each resting member are carried by two pivoting arms and, in case when two resting members are used, each of both arms can advantageously carry two jaws belonging, respectively, to each of both resting members.

Figure 10:
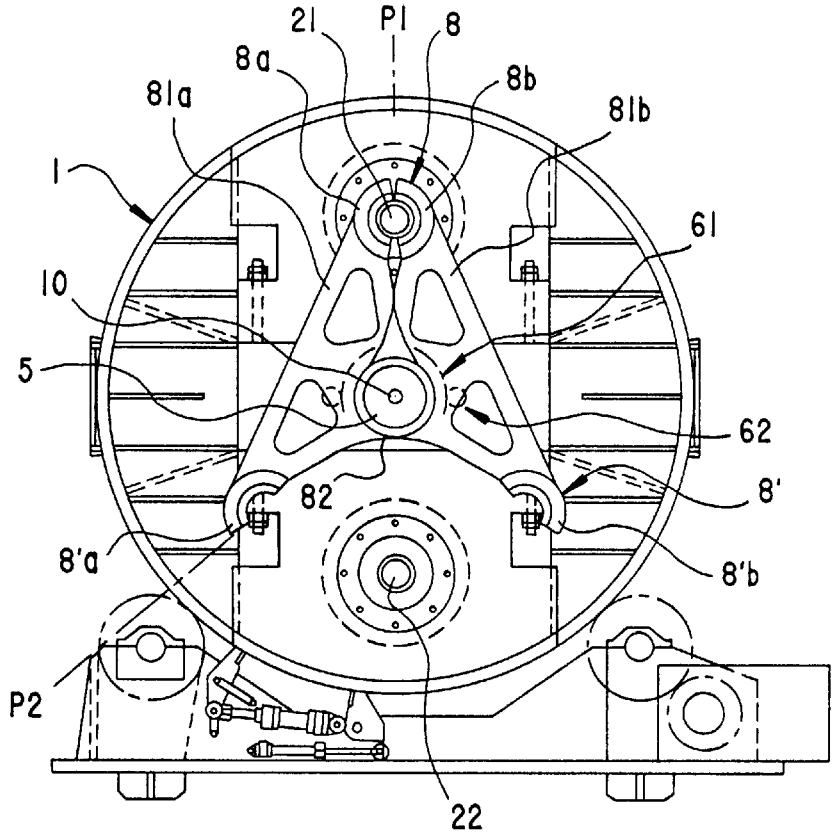
FIG. 10 and FIG. 11 are diagrammatic views of two other embodiments of the invention.

In the embodiment represented on FIG. 10, for example, the resting member 8 is constituted of two jaws 8*a*, 8*b* each placed at one end of an arm 81*a*, 81*b* carrying, at its other end, a jaw 8'*a*, 8'*b* of the other resting member 8'. Both arms 81*a*, 81*b*, are articulated, in their central part, on a central shaft 5, around a common pivot 82 centred on the axis 10 of the revolving mounting 1, whereas the centres of the jaws are placed at the same distance from the central axis 10 as the axes of both chucks 21, 22.

Moreover, the jaws carried by each arm 81 are offset laterally with respect to the pivot 82 in such a way that the planes P1, P2 going through the central axis 10 and the centres of the jaws 8*a*, 8'*a* form an obtuse angle.

Each of both arms 81*a*, 81*b*, is provided with a toothed sector 61 on which engages a pinion 62 actuated by a mechanism installed on the revolving mounting 1 and able to cause the arm 81 to rotate in one direction or the other.

Thus, by rotation of both arms 81*a*, 81*b*, both jaws 8*a*, 8*b* come closer to one another, like a clamp, at the end 24 of the shaft of one of the chucks 21 while both other jaws 8'*a*, 8'*b* move away from the other chuck 22 over a sufficient distance to enable removal of the wound coil.

As in the case illustrated on FIG. 7, the arms 81 supporting the jaws remain in a plane perpendicular to the central axis 10. The central shaft 5 can thus either extend cantilever from the revolving mounting 1 or rest on a fixed bracket at its end opposite to the mounting 1.

Figure 11:
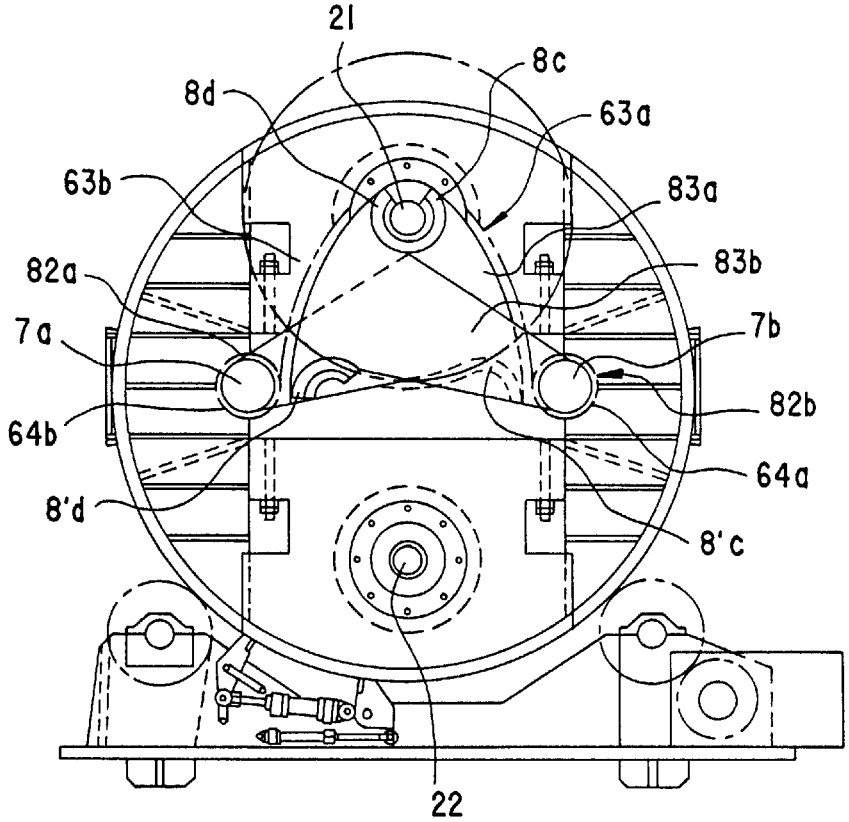

In the embodiment of FIG. 11, the arms 83*a*, 83*b* supporting the resting members 8, 8' are articulated, respectively, on pivots 82*a*, 82*b* whose axes are parallel to the central axis 10 and arranged at the ends of two stems 7*a*, 7*b*, each forming a resting beam, in a similar way to the embodiment of FIG. 6.

Each resting member 8, 8' is also constituted of two semi-bushes arranged on two jaws 8*c*, 8*d* carried, respectively, by both arms 83*a*, 83*b*. In such a case, however, each of both arms 83*a*, 83*b* extends between both chucks 21, 22 and exhibits a shape like an angular sector mounted to pivot, at its apex, on a stem 7*a*, 7*b* and carrying two jaws, spread apart from each other, respectively 8*c*, 8'*c* and 8*d*, 8'*d* whose centres are located on a circle centred on the axis of the corresponding pivot 82*a*, 82*b* and going through the axes of both chucks 21, 22.

Thus, by rotation in the reverse direction of both arms 83*a*, 83*b*, a first pair of jaws 8*c*, 8*d* clamps the end 24 of a first chuck 21 whereas both other jaws 8'*c*, 8'*d* are sufficiently away from the second chuck 22 to enable unloading of the coil.

By rotations in reverse direction, the second pair of jaws 8'*c*, 8'*d* clamp the second chuck 22 whereas both other jaws 8*c*, 8*d* move away from both sides of the first chuck 21.

Each of both arms 83*a*, 83*b* is provided with a toothed sector 63*a*, 63*b* centred on the axis of the corresponding resting stem 7*a*, 7*b* and on which engages a pinion 64*a*, 64*b* centred on the axis of the other resting stem 7*b*, 7*a*.

FIG. 12 represents three operating steps of such a coiler.

Figure 12A:
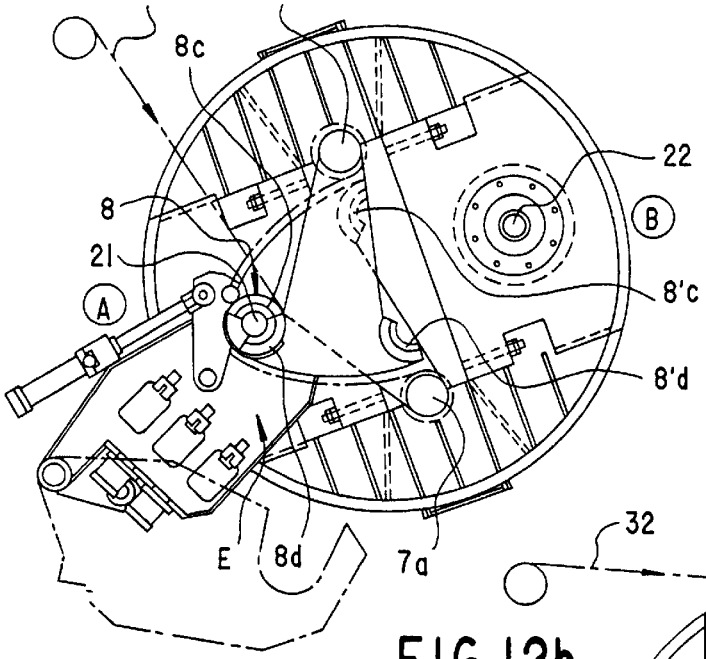
FIGS 12*a*, 12*b*, 12*c* show the operating steps of the embodiment of FIG. 11.

On FIG. 12*a*, the chuck 21 is in the starting position A. Both jaws 8*c*, 8*d* are clamped on the end of the shaft of the first chuck 21 whereas both other jaws 8'*c*, 8'*d* are taken away from the second chuck 22 located in the releasing position B, in order to enable removal of the coil 3 after complete winding. A winder E of known type is applied to the chuck 21 in order to facilitate the hooking of the band 32 and the start of the winding operation.

Figure 12B:
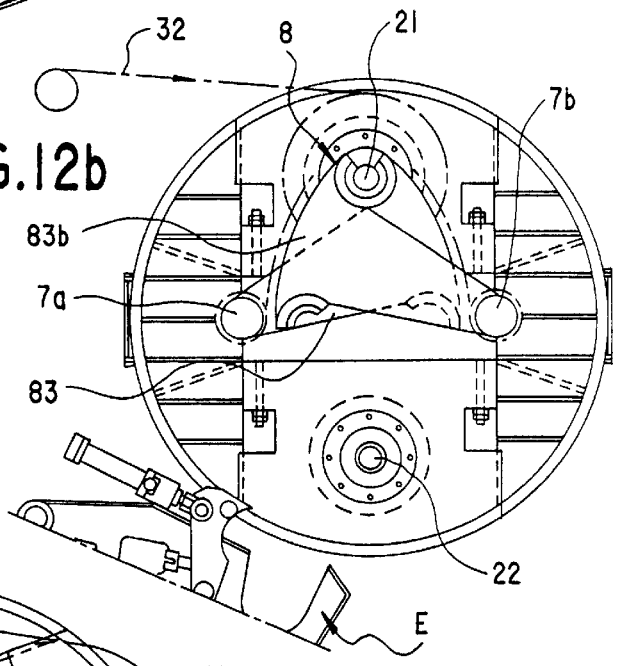

FIG. 12*b* shows an intermediate position of the revolving mounting. The first chuck 21 on which the winding of the band 32 takes place, is supported by both arms 83*a*, 83*b*, whereas the other chuck 22 is unloaded.

Figure 12C:
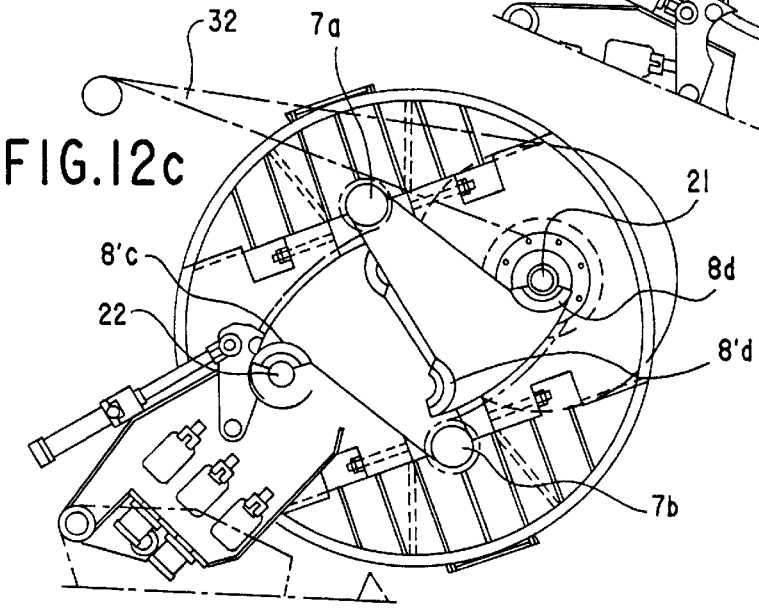

FIG. 12*c* shows the end of the winding operation, whereby the first chuck 21 is in the unloading position B. It may be advantageous to control separately the rotations of both arms 83*a*, 83*b*. For instance, on FIG. 12*c*, the supporting arm 83*b* has already moved away to install the jaw 8'*c* onto the second chuck 22 which is located in the starting position A, whereas the chuck 21 can still be supported by the arm 83*a* until taken over by the coil.

The arm 83*a* is then caused to pivot so that the chuck 22 is held by both clamped jaws 8'*c*, 8'*d*.

The device represented on FIG. 10 operates in a similar way.

Of course, other operating modalities can be contemplated, since the possibilities are numerous.

What is claimed is:

1. A revolver-type coiler for winding of a band-type product around one of at least two chucks comprising:

a revolving mounting structured to rotate around a central axis on a fixed frame, at least two winding chucks extending cantilever on a same side of the revolving mounting, from a first end embedded on the mounting up to a second opposite end, each chuck having a shaft and rotating on the revolving mounting around an axis, out of center of the revolving mounting and parallel to the central axis, means for selective control of the rotation of one of both winding chucks around a respective axis, means for controlling the rotation of the revolving mounting around said central axis, for selective positioning of a first winding chuck into a first winding starting position, then the switching of the winding chuck from the first position to at least one second position for completion of winding and unloading of the coil, with simultaneous return of the second unloaded chuck from the second position to the first position, and a continuous supporting device of the second end of the shaft of each winding chuck opposite to the revolving mounting from the first starting position to the completion of winding position, said support device comprising at least one rotary removable resting member for said second end of the shaft resting on the fixed frame, and a supporting means installed to rotate together with the revolving mounting around the central axis of the revolving mounting for supporting the at least one rotary removable resting member, said supporting means of the removable resting member comprising:

at least one resting stem having a first end embedded in the revolving mounting and extending along a direction parallel to the central axis, at least one supporting arm which is articulated on said at least one resting stem, around an axis parallel to the central axis, and at a distance greater than the width of a coil, and means for controlling the rotation of said at least one supporting arm around said axis between a first engagement position of the removable resting member on the second end of the chuck and a second disengagement position of said resting member, the supporting arm being offset in said second position at an angle with respect to the chucks so that the resting member is moved away sufficiently far from the chucks to enable the unloading of a completely wound coil.

2. A revolver-type coiler according to claim 1, wherein the removable resting member comprises at least two jaws each located at the end of an arm installed to pivot on a respective resting stem around an axis parallel to the central axis, between an open position for which both jaws are at sufficient distance from the chuck, to allow the removal of the coil, and a closed position for which the jaws are tightened onto the end of the chuck, forming a clamp.

3. A revolver-type coiler according to claim 2, comprising two chucks installed on the revolving mounting, and two resting members each comprising a pair of jaws and two pivoting arms each pivot arm carrying the two jaws belonging respectively to each of both resting members so that one of both chucks is supported alternately by pivoting both arms into one direction or the other, wherein both jaws of one pair are in closed position on one of the chucks when both jaws of the other pair are spread away from one another, in open position, on both sides of the other chuck.

4. A revolver-type coiler according to claim 3, wherein both supporting arms are articulated in a central section thereof on a central resting shaft around a pivot centred on the axis of the revolving mounting and carry at two opposite ends, two jaws of two different pairs, which are centred respectively on axes which are placed at the intersection of a cylindrical surface centred on the axis of the pivot and passing through the axes of both chucks and two planes passing through the pivoting axis and offset at an angle, in order to form two clamps, one of which being open when the other is closed.

5. A revolver-type coiler according to claim 3, wherein both supporting arms are articulated each around a pivot respectively on two resting stems moved away symmetrically from the central axis on a plane perpendicular to the plane passing through the axes of both chucks, and extending towards one another by passing between both chucks, and wherein each supporting arm carries two jaws spread apart, belonging to two resting members, different and centred respectively on axes which are situated at the intersection of a cylindrical surface centred on the corresponding pivot axis by passing through the axes of both chucks and two planes passing through the pivot axis, an acute angle being formed between the respective two planes, whereas the acute angles of both arms are equal so that, by rotation of both arms towards one another, both jaws of a first resting member are tightened onto a first chuck whereas the jaws of the second resting member are open on both sides of the second chuck and vice versa.

6. A revolver-type coiler according to claim 1, wherein the removable resting member comprises a counterbearing centered on the axis of the chuck interposed between a journal provided at the end of the chuck opposite to the revolving mounting and an end of a related supporting arm.

7. A revolver-type coiler according to claim 6, wherein the counterbearing is carried by a part installed to slide, parallel to the central axis, on the end of the supporting arm, whereby the end of the support arm is provided with means to control the sliding motion of the part for engaging or disengaging the counterbearing.

8. A revolver-type coiler according to claim 6, in which each chuck comprises an expansion control stem movable axially for the expansion or the retraction of the chuck, wherein the axial displacement of the control stem also determines, in the expansion direction, the engagement of the end of the stem into a corresponding recess of the supporting arm and, in the retraction direction, the disengagement of the end of the stem from the recess, whereas the latter where the end of the stem rotatably rests inside the recess.

* * * * *